United States Patent [19]

Isao

[11] Patent Number: 4,568,118

[45] Date of Patent: Feb. 4, 1986

[54] LIFTING HOOK

[75] Inventor: Oda Isao, Fukayasu, Japan

[73] Assignee: F. T. Industries Co., Ltd., Japan

[21] Appl. No.: 623,534

[22] Filed: Jun. 22, 1984

Related U.S. Application Data

[63] Continuation of Ser. No. 384,126, Jun. 1, 1982, abandoned.

[30] Foreign Application Priority Data

May 30, 1981 [JP] Japan ..... 56-82704

[51] Int. Cl.[4] ..... B66C 11/34

[52] U.S. Cl. ..... 294/82.16; 294/82.19

[58] Field of Search ..... 294/82 R, 78 R, 83 R; 24/233, 235, 239, 230.5, 232, 242

[56] References Cited

U.S. PATENT DOCUMENTS 3,230,004 1/1966 Lock ..... 244/82 R 3,250,563 5/1966 Walsh ..... 294/78 R

*Primary Examiner*—James B. Marbert

*Attorney, Agent, or Firm*—William A. Drucker

[57] ABSTRACT

The present invention mainly relates to improvements in the head construction of a lifting hook, wherein the hook head has an annular recess over its certain axial length, the upper portion of said recess forming a double curvature profile, and the surface of said recess being pressurized by a rolling roller to develop a compressive residual stress. An external half sleeve is fitted on said annular recess and seated on a thrust bearing, the sleeve being surrounded with a collar nut.

1 Claim, 5 Drawing Figures

LIFTING HOOK

This application is a continuation of application Ser. No. 384,126 filed June 1, 1982 now abandoned.

BACKGROUND OF THE INVENTION

A lifting hook is one of the important parts for maintaining a crane unit. Most hooks in current use are so constructed that they have a threaded head engaged with a nut supported by a thrust bearing. In such threaded hooks stress concentration occurs at the thread root especially when an eccentric load is applied, frequently resulting in cutting failure, to which most cutting accidents in the past were attributed.

OBJECTS OF THE INVENTION

Therefore, one of the primary objects of the present invention is to greatly improve the safety and durability of the hook. Another object of the present invention is to shorten the length of the hook head and hence achieve a compact constitution. Still another object of the present invention is to facilitate assembling and disassembling the hook. These and other objects of the present invention will be made clearer through the following description.

BRIEF DESCRIPTION OF THE DRAWINGS

FIGS. 3, 3A and 3B are detail views of the shank of an embodiment.

DESCRIPTION OF THE PREFERRED EMBODIMENT

Figure 1:
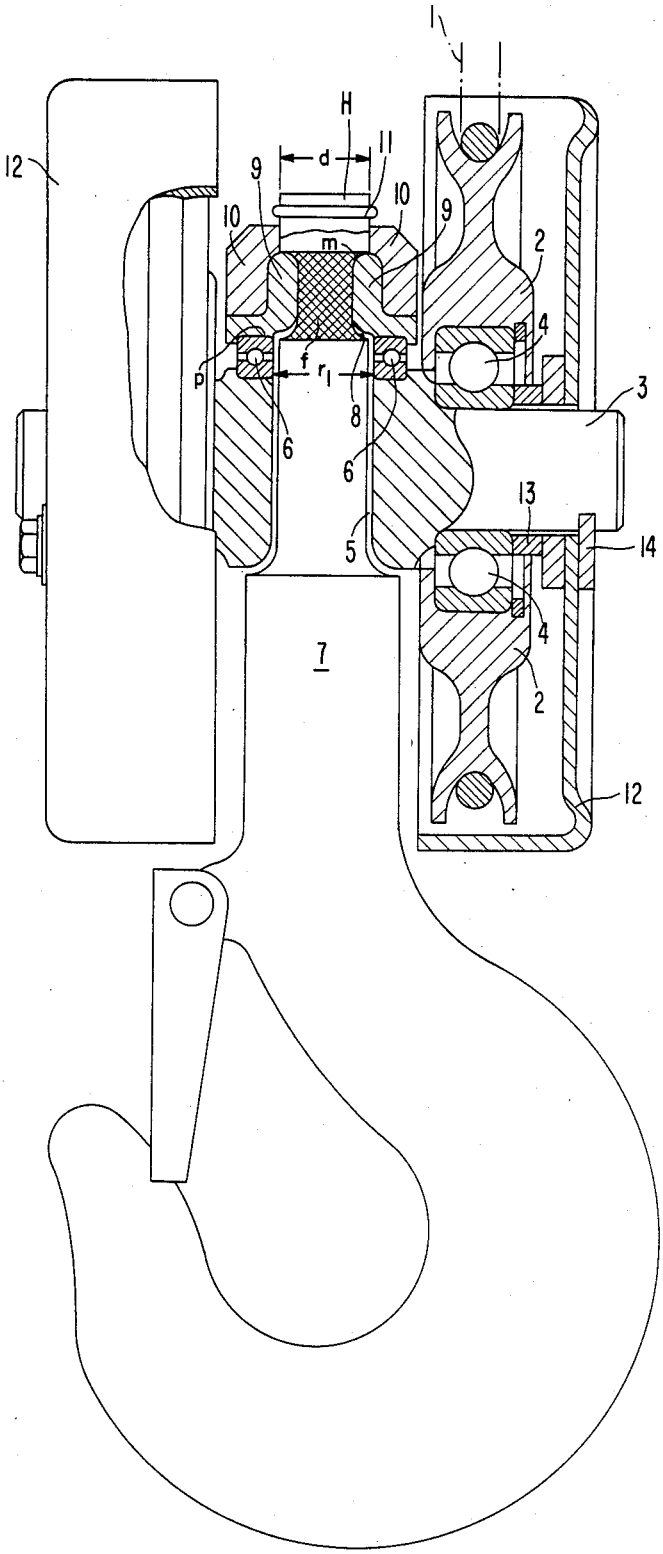
FIG. 1 is a partly cutaway front view of an entire hook embodying the present invention.

Numeral 1 designates a hoisting rope leading from the main body of a crane unit (not illustrated herein), which is carried by a sheave designated by reference numeral 2; numeral 3 indicates a crosshead. Said sheave 2 is rotatably pivoted by way of a sheave bearing 4. Said crosshead 3 has a through hole 5 at the center into which the hook head to be described later is inserted, and a thrust bearing 6 mounted on the top.

Figure 2:
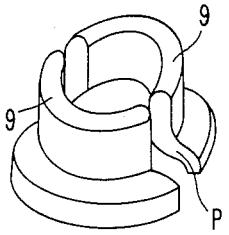
FIG. 2 is a perspective view showing a half sleeve.

Numeral 7 designates the hook body, the head of which is placed into said through hole 5, with the upper portion projecting upward and having an annular recess 8 over its certain axial length. The head top H is so designed that the outside diameter (O.D.) d is not more than the inside diameter (I.D.) r of a thrust bearing 6. On said annular recess 8 is fitted a half sleeve 9 with O.D. larger than said O.D. of the head top (See FIG. 2) whose unfolding lower end shaped like a trumpet p is seated on a thrust bearing 6.

Figure 3A:
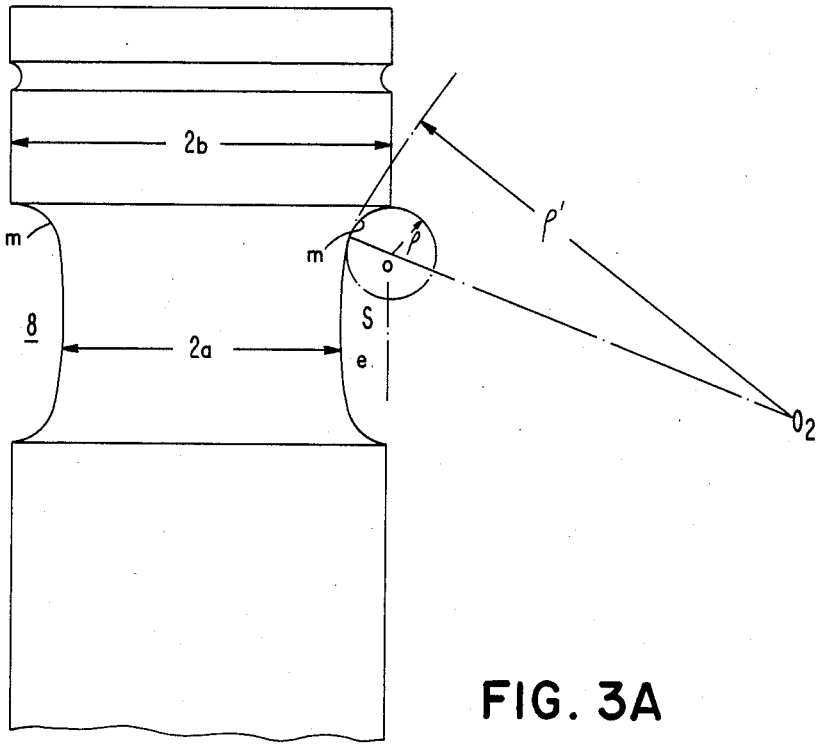

Numeral 10 indicates a collar nut which is to be fitted on the circumferences of said head top H and said sleeve 9, and whose I.D. is equal to or larger than the I.D. of the trust bearing 6 in order to get in harmony with the O.D. of said head top H and the circumferential dimension of said sleeve 9. In FIG. 1 numeral 11 designates a snap ring for securing a collar nut 10 against the head top to keep it in its place, 12 indicating a sheave cover, 13 a cradle, and 14 a key brake respectively. In the present invention said annular recess 8 on which the sleeve 9 is fitted is formed into a special fillet as shown in the detail views of FIG. 3 to eliminate stress concentration. First as illustrated in FIG. 3A, the fillet S is so formed that the upper part draws a double curvature profile m, which has made it possible to eliminate most of stress concentration on the fillet which cannot be dissipated with a single curvature radius in the prior art, and also to shorten the length over which the profile changes. Since points of maximum stress lie in the range of 8° to 15° up from the horizontal axis, taking a larger radius of curvature particularly over this range will provide effective relief of stress concentration.

Figure 3B:
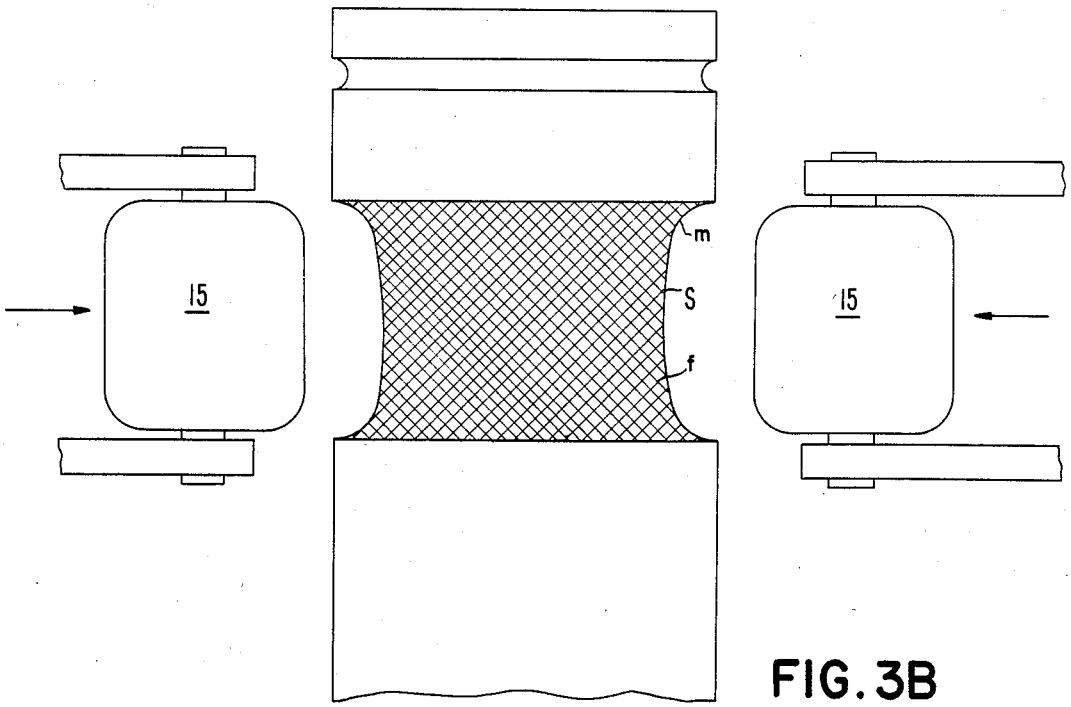

As a result of photoelastic experiments made by assuming $e=b-a=a/2=\text{constant}$ and $P=0.5e$ or $P=0.75e$, and taking the varying values of $P'/P$ in each case, it has proved that for tensile load the rate of stress concentration $\alpha=1.06$, which is trivial, when $P=0.5e$ and $P'/P=16$, and that $\alpha=1.0$ when $P=0.75e$ and $P'/P=16$. Secondly, as shown in FIG. 3B, pressure is applied on said fillet by the use of a rolling roller 15 to develop plastic deformation f as much as 0.1 mm from the diameter so that increased hardening and tensile strength of the outermost layer can be effected at the curvature and that compressive residual stress may be developed at the longitudinal section, thus increasing fatique strength against repeated load.

Figure 4:
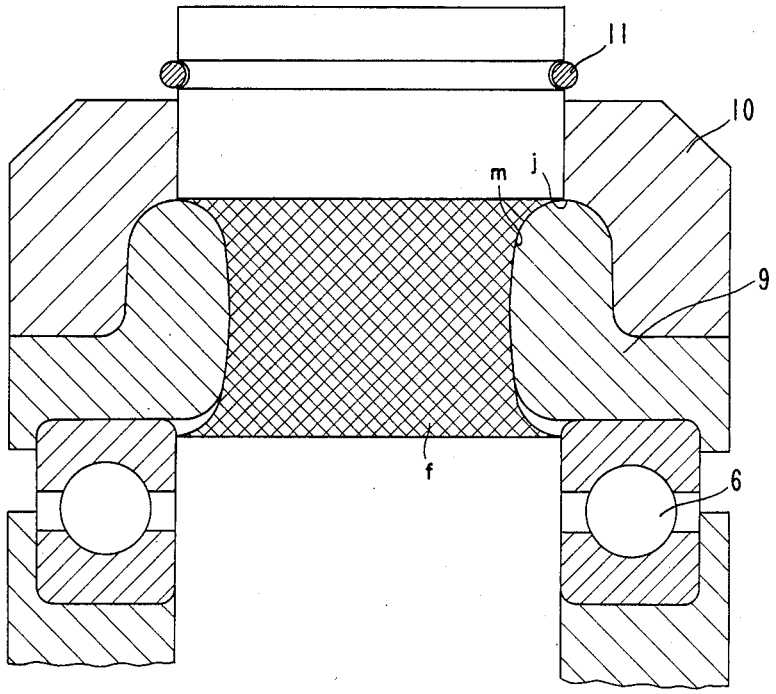
FIG. 4 is a detail view of a hook head assembly.

FIG. 4 is the portion detail view of the assembly of said special fillet of said construction on which said sleeve and nut are fitted, showing the head j of said sleeve 9 so profiled that one side matches with said curvature profile m and that the other side cuts into the side of the collar nut 10. In this case the sleeve 9 is of soft material e.g. white metal (WJ7) which is suitable for said profile and can prevent dent due to compressive load.

In the present invention of said construction a load applied on the hook body 7 is transmitted to said sleeve 9 by the hook head, and then via the thrust bearing 6 to the crosshead 3. The load is further transferred by way of the sheave bearing 4 to the rotation sheave 2, then through the hoisting rope 1 up to the crane body not illustrated herein. The present invention has completely eliminated the thread of the hook head, thus preventing the development of concentrated stress at the thread root which may cause cutting failure as seen in the prior art and hence resulting in the production of a lifting hook of high safety. The present invention has also succeeded in reducing almost perfectly stress concentration of the fillet that cannot be avoided with the conventional single curvature radius by the formation of said double curvature profile, and shortening the length subject to sectional change, which has finally effected a very compact constitution. Furthermore, finishing said portion by means of a collar roller has enabled effective compressive residual stress to develop at the surface and has provided the smooth surface after cutting, leading to a drastic improvement in durability. According to the inventor's experiment, when a 10-ton repeated load was applied on the conventional threaded three-ton hook (metric screw 30 mm in diameter), it broke down at 650,000 times, while the hook with a shank 25 mm in diameter embodying the present invention could withstand three million times of application of a ten-ton repeated load without severing, and after that the experiment was stopped. Accordingly, such a drastic improvement has been made that the hook head in accordance with the present invention has durability three times higher than that with the conventional one.

In the present invention the head of the sleeve 9 partly cut into the side of the collar nut 10 can help to prevent said sleeve from filling in the clearance of the collar nut when said sleeve gets deformed toward the side thereof under load, therefore facilitating assembling and disassembling and the hook and further maintenance operations.

I claim:

1. A lifting hook for use in a crane hoist comprising a hook portion and an unthreaded shank portion, said shank portion including an annular groove having a bottom wall which has a continuous curved concave surface formed of curves of differing radius of curvature, the curve of the smaller radius of curvature being located adjacent one end of said groove between 8° and 15° from the horizontal between said edge portions in combination with a pair of diametrically opposed rollers disposed in said groove and transmitting load stress to a hoist.

* * * * *